US011248435B1

(12) United States Patent
Yue et al.

(10) Patent No.: US 11,248,435 B1
(45) Date of Patent: Feb. 15, 2022

(54) FRAC PLUG SYSTEM WITH A SETTING MANDREL AND FLUID BYPASS SLOTS

(71) Applicant: CNPC USA Corp., Houston, TX (US)

(72) Inventors: Jianpeng Yue, Sugar Land, TX (US); Peng Cheng, Sugar Land, TX (US); Yu Liu, Beijing (CN); Xu Wang, Beijing (CN); Richard Herrera, Spring, TX (US)

(73) Assignee: CNPC USA Corp., Houston, TX (US)

( * ) Notice: Subject to any disclaimer, the term of this patent is extended or adjusted under 35 U.S.C. 154(b) by 0 days.

(21) Appl. No.: 16/994,429

(22) Filed: Aug. 14, 2020

(51) Int. Cl.

| | |
|---|---|
| ***E21B 33/128*** | (2006.01) |
| ***E21B 33/129*** | (2006.01) |
| ***E21B 33/12*** | (2006.01) |
| ***E21B 43/26*** | (2006.01) |

(52) U.S. Cl.
CPC ..... *E21B 33/1208* (2013.01); *E21B 33/1293* (2013.01); *E21B 43/26* (2013.01); *E21B 2200/01* (2020.05)

(58) Field of Classification Search
CPC ..... E21B 33/1294; E21B 33/1293; E21B 33/1292; E21B 33/1291; E21B 33/129; E21B 33/128; E21B 33/12
See application file for complete search history.

(56) References Cited

U.S. PATENT DOCUMENTS

| | | | | |
|---|---|---|---|---|
| 2,143,251 | A | 1/1939 | Savitz | |
| 2,627,317 | A | 2/1953 | Baker | |
| 3,298,437 | A | 1/1967 | Conrad | |
| 4,185,689 | A * | 1/1980 | Harris | E21B 23/02 166/133 |
| 4,286,661 | A | 9/1981 | Gazda | |
| 4,784,226 | A | 11/1988 | Wyatt | |
| 6,796,376 | B2 | 9/2004 | Frazier | |
| 7,424,909 | B2 | 9/2008 | Roberts | |
| 9,470,061 | B2 * | 10/2016 | Sjostedt | E21B 33/134 |
| 9,982,506 | B2 * | 5/2018 | Walton | E21B 33/13 |
| 10,400,540 | B2 | 9/2019 | Williamson et al. | |
| 10,450,829 | B2 * | 10/2019 | Melenyzer | E21B 33/1204 |
| 10,626,697 | B2 * | 4/2020 | Dirocco | E21B 33/1293 |

* cited by examiner

*Primary Examiner* — Kenneth L Thompson

(74) *Attorney, Agent, or Firm* — Craft Chu PLLC; Andrew W. Chu

(57) ABSTRACT

The frac plug system includes a setting mandrel, a sleeve member, a sealing member, a cone assembly, and a slip device. The setting mandrel includes a plurality of fluid bypass slots. The sleeve member includes a sleeve body with an abutment end. The setting mandrel has a first configuration without fluid flow through the frac plug system, and a second configuration with fluid flow through the frac plug system. The methods of the present invention include running the frac plug system in the first configuration and the sealing member in an extended position for a first setting stage, moving the setting mandrel to the second configuration with the sealing member in an expanded position, and then returning the setting mandrel to the first configuration for a second setting state. If the placement is wrong, the method includes removing the frac plug system in the first setting stage.

20 Claims, 2 Drawing Sheets

FRAC PLUG SYSTEM WITH A SETTING MANDREL AND FLUID BYPASS SLOTS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a frac plug system that sets in position and sets a seal for isolating zones in a wellbore. Even more particularly, the present invention relates to a frac plug system with a pre-set seal, while setting in position in multiple stages.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tool with an isolation valve.

In the conventional process, the frac plug device is run to a downhole location. When located in the correct place, the setting tool that traveled with the frac plug device will set the packer, i.e. expand the frac plug against the walls of the borehole. Then, the settling tool is removed. The frac plug still must be activated in order seal the zone. The frac plug is sealed to the borehole, but fluid still flows through the packer. Conventionally, a frac ball is dropped into the borehole. The frac ball travels to the downhole location to sit on a ball seat, which triggers the actual seal across the frac plug. Fracking can commence with the actual seal across the packer. The frac fluids are only delivered to the isolated zone, and production fluids are only harvested from the isolated zone.

There also frac plug devices that do not require a frac ball. U.S. Pat. No. 3,298,437, issued on 1967 Jan. 17 to Conrad, discloses background information for setting a plug. The mandrel is solid, and there is not even a ball seat or other trigger. The seal is formed when the plug is set. U.S. Pat. No. 4,784,226, issued on 1988 Nov. 15 to Wyatt, and U.S. Pat. No. 7,424,909, issued on 2008 Sep. 16 to Roberts et al also disclose the conventional setting of a plug to create the sealed borehole as soon as set. U.S. Pat. No. 6,796,376, issued on 2004 Sep. 28 to Frazier discloses the conventional sealed plug as setting with the shearing at the end of the mandrel. This type of frac plug is a pre-set frac plug because the frac plug is already sealed when set in position.

There are also versions of a pre-set frac plug system with a frac ball. U.S. Pat. No. 2,627,317, issued on 1953 Feb. 3 to Baker, discloses a well tester with pre-set frac ball. The tester is run in with the frac ball in place. The tester is triggered to seal against the borehole wall. The ball member and ball valve can be actuated by pressure to open the tester at the bottom. The frac ball is deployed in place with the frac plug, so that the frac plug forms the actual seal across the frac plug as soon as the setting tool is used.

The problem with the pre-set frac plug is the risk of accidentally triggering a pre-set frac plug. Boreholes are not straight and smooth. There are bumps and turns. When a conventional frac plug is accidentally triggered or accidentally set in position at the wrong downhole location, strong acid is pumped into the borehole to dissolve the plug. There is no frac ball, so there can be fluid injection to remove the accidentally triggered frac plug. However, with a pre-set frac plug in the wrong downhole location, there is no pumping because the accidentally triggered pre-set frac plug already has a pre-set seal across the frac plug. Thus, pre-set frac plug are very risky.

There are frac plugs and packers with flow bypass systems for delivery of fluids pasta frac plug or packer in a wellbore. U.S. Pat. No. 2,143,251, issued on 1939 Jan. 10 to Savitz, discloses a tool with a circulating valve that actuates from a run-in position to a set position. The mandrel moves the openings from a sealed position to a flow position. U.S. Pat. No. 4,286,661, issued on 1981 Sep. 1 to Gazda, shows another equalizing valve with a run in position and a set position. The open flow position can be actuated by movement of the slit openings into a spaced window and lower than the spaced window. U.S. patent Ser. No. 10/400,540, issued on 2019 Sep. 3 to Williamson et al shows flow restriction channels along the exterior of a mandrel that are selectively opened.

It is an object of the present invention to provide a frac plug system to isolate zones in a wellbore.

It is an object of the present invention to provide a frac plug system to be easily removed, if accidentally triggered in the wellbore.

It is an object of the present invention to provide a frac plug system with multiple stages for isolating a zone in a wellbore.

It is another object of the present invention to provide a frac plug system having a setting mandrel with fluid bypass slots and a sleeve member.

It is an object of the present invention to provide a frac plug system with multiple stages for isolating a zone with fluid pressure variation.

It is an object of the present invention to provide a frac plug system that is removeable during different stages of the process of isolating a zone.

It is another object of the present invention to provide a frac plug system that is removeable by injecting a strong acid.

These and other objectives and advantages of the present invention will become apparent from a reading of the attached specification, drawings and claims.

BRIEF SUMMARY OF THE INVENTION

Embodiments of the present invention include a frac plug system with a pre-set seal. Once the frac plug system is set in position within a wellbore, there is no need for a frac ball or other operation to form the seal at the position within the wellbore. The frac plug system of the present invention has components so that setting in position is split into multiple stages, which allows quick removal if the trigger to start the setting in position was wrong or accidental.

The present invention is a frac plug system comprising a setting mandrel, a sleeve member, a sealing member, a cone assembly, and a slip device. The setting mandrel includes a mandrel body, a plurality of fluid bypass slots, and a sealing shoulder surface. The fluid bypass slots extend longitudinally along the mandrel body. Each slot has an opened end and a closed end. In some embodiments, the setting mandrel can have O-ring grooves for O-rings in sliding engagement between the sleeve member and the setting mandrel. the sleeve member includes a sleeve body with an outer sleeve surface, an abutment end and a free end. The setting mandrel has a first configuration without fluid flow through the packer system because the closed ends of the slots are covered by the sleeve member. The setting mandrel has a second configuration with the closed ends of each slot open and fluid connection through the frac plug system.

In embodiments of the present invention, the abutment end of the sleeve member is mechanically engaged with a seal end of the setting mandrel. The mechanical engagement includes direct contact, like being adjacent, or other connection so as to exert force on each other. In one embodiment, the abutment end is a conical wedge cooperative with a sealing shoulder surface of the setting mandrel.

Embodiments of the sealing member, cone assembly, and slip device of the present invention include conventional components of a frac plug to set the frac plug system in position in the wellbore. The slip device anchors to the wellbore. The sealing member seals against the wellbore so that there is no fluid flow around the frac plug system. The cone assembly slides into the slip device to press the slip device into the wellbore. The sealing member has an extended position and an expanded position with a diameter for sealing against the wellbore larger than the diameter of the extended position.

In the present invention, the second configuration of the setting mandrel only corresponds to the sealing member in the expanded position at the first setting stage. The first configuration of the setting mandrel corresponds to both the sealing member in the expanded position at the second setting stage and the sealing member in the extended position, while being run-in before any setting stages.

Embodiments of the present invention include the method for isolating a zone in a wellbore. The method includes running a frac plug system in a borehole with a setting tool. The setting mandrel is in the first configuration, and the sealing member is in the extended position. Next, the frac plug system is placed in a location in the wellbore, which can include breaking the setting mandrel with the setting tool.

The method now includes transitioning the sealing member in the extended position to the sealing member in the expanded position at the location and moving the setting mandrel from the first configuration to the second configuration so as to form a fluid connection through the fluid bypass slots in a first setting stage of setting in position. In some embodiment, fluid pressure is applied to exert force on the abutment end of the sleeve member, which compresses the sealing member and moves the sleeve member along the setting mandrel to the second configuration of the setting mandrel. The fluid bypass slots are now in fluid connection through the frac plug system. The closed ends of the slots allow fluid flow and pumping through the frac plug system.

Next, the method includes moving the setting mandrel from the second configuration to the first configuration so as to seal the fluid connection in a second setting stage. The pre-set seal at the seal end of the sleeve member is finally moved into place. In the embodiments with fluid pressure, additional fluid pressure is applied to the seal end to exert force on the setting mandrel. With the sleeve member anchored by the sealing member and slip device, the setting mandrel now moves toward the sleeve member. The setting mandrel returns back to the first configuration, closing the fluid bypass slots in the second setting stage. In the second setting stage, the setting in position is completed so that the pre-set seal can form a seal across the frac plug system to isolate a zone.

Alternative embodiments of the method of the present invention include the step of injecting fluids to remove the frac plug system. If the frac plug system is in the wrong place by accident or unintentionally, strong acid can be injected to dissolve the frac plug system or at least components of the frac plug system so that the frac plug system is removed from the wrong place in the wellbore. The fluid bypass slots allow pumping acid or other additives to be delivered to the frac plug system.

The present invention provides a frac plug system with multiple stages to isolate zones in a wellbore. The frac plug system is pre-set because no additional stage is needed to set the seal. A frac ball and related ball seat are no longer needed. The present invention includes components for multiple stages for setting in position to isolate the wellbore.

DETAILED DESCRIPTION OF THE INVENTION

Conventional frac plugs and packers set in position and set a seal in separate stages. Pre-set frac plugs are set in position and set a seal in a single stage, and there is no need for another stage. Although efficient, there is high risk of setting position and setting the seal in the wrong location accidentally. The present invention is a frac plug system that is pre-set because setting the seal remains concurrent with setting in position. The seal is pre-set. The frac plug system of the present invention has components so that setting in position is split into multiple stages, which allows quick removal if the trigger to start the setting in position was wrong. There are multiple stages for setting in position, even though setting the seal is pre-set.

Figure 1:
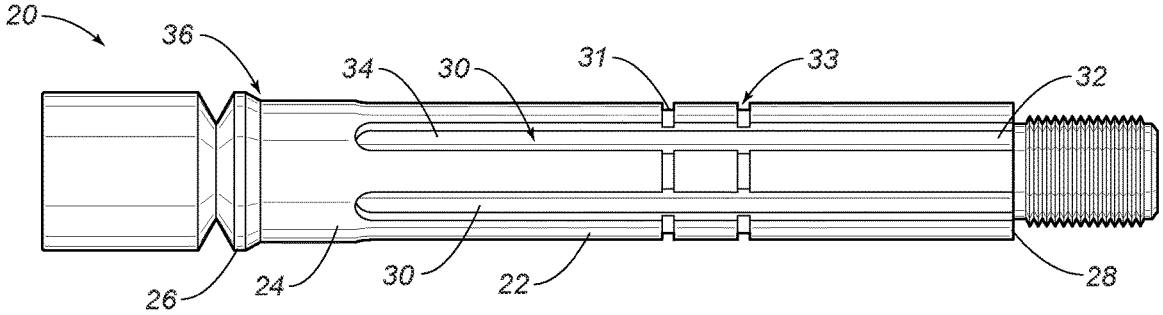
FIG. 1 is a side elevation view of an embodiment of the setting mandrel and fluid bypass slots of the frac plug system according to the present invention.

Referring to FIGS. 1-4, the present invention is a frac plug system 10, including a setting mandrel 20, a sleeve member 40, a sealing member 60, a cone assembly 70, and a slip device 72. FIG. 1 shows the setting mandrel 20 being comprised of a mandrel body 22, a plurality of fluid bypass slots 30, and a sealing shoulder surface 36. The mandrel body 22 has an outer mandrel surface 24, a seal end 26 and a flow end 28 opposite the seal end 26. The fluid bypass slots 30 extend longitudinally along the mandrel body 22 from the flow end 28 toward the seal end 26. Each slot 30 has an opened end 32 at the flow end 28 of the mandrel body 22 and a closed end 34 between the seal end 26 and the flow end 28. The sealing shoulder surface 36 is at the seal end 26 so that the closed end 34 is between the sealing shoulder surface 36 and the flow end 28.

Figure 2:
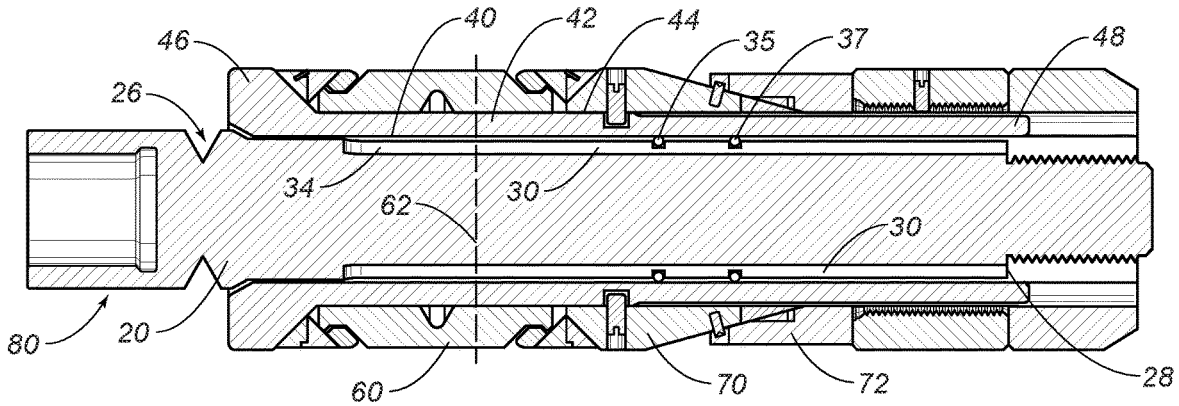
FIG. 2 is a sectional view of an embodiment of the frac plug system according to the present invention with the setting mandrel in the first configuration and the sealing member in an extended position.
Figure 3:
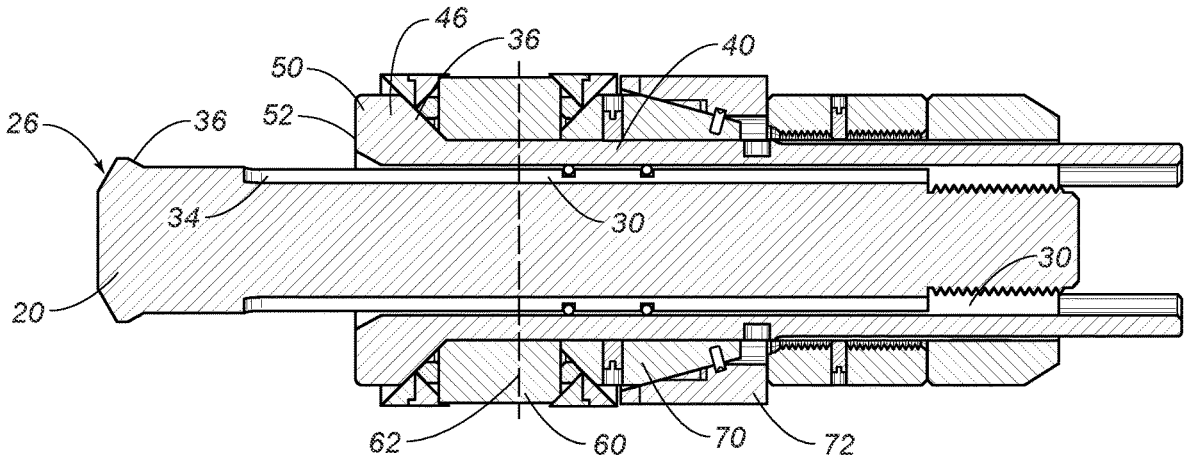
FIG. 3 is a sectional view of an embodiment of the frac plug system according to the present invention with the setting mandrel in the second configuration and the sealing member in an expanded position.
Figure 4:
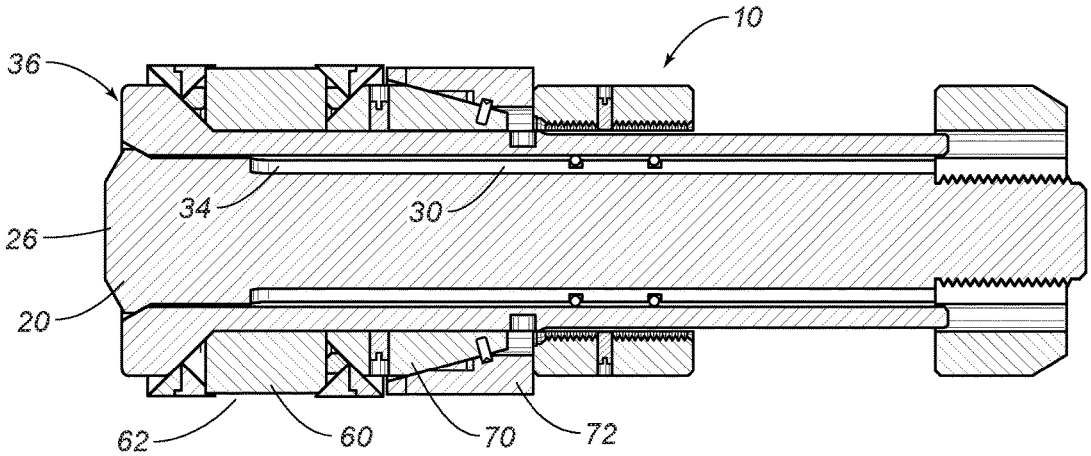
FIG. 4 is a sectional view of an embodiment of the frac plug system according to the present invention with the setting mandrel in the first configuration and the sealing member in an expander position.

In some embodiments, the setting mandrel 20 is further comprised of an O-ring groove 31 between the closed end 34 and the opened end 32 of each slot 30. FIGS. 2-4 show an O-ring 35 set in the O-ring groove 31 in sliding engagement with the sleeve member 40. There can also be an additional O-ring groove 33 between the closed end 34 and the O-ring groove 31 of each slot 30 and an additional O-ring 37 set in the additional O-ring groove 33.

FIGS. 2-4 show the sleeve member 40 being comprised of a sleeve body 42 with an outer sleeve surface 44, an abutment end 46 and a free end 48 opposite the abutment end 46. The setting mandrel 20 has a first configuration with the seal end 26 adjacent the abutment end 46 of the sleeve member, and a second configuration with the closed end 36 of each slot 30 between the seal end 26 and the abutment end 46. The first configuration has the sleeve member 40 mechanically engaged to the seal end 26 of the setting mandrel 20. Mechanically engaged means that the sleeve member 40 is in physical contact with the setting mandrel 20 or adjacent so that sleeve member 40 and setting mandrel can exert pressure on each other.

In one embodiment, the abutment end 46 is adjacent to the seal end 26. The abutment end 46 is comprised of a conical wedge 50 having a first end 52 facing the sealing shoulder surface 36 of the setting mandrel 20 and a second end 54 opposite the first end 52. The first end 52 is wider than the second end 54 so as to set the orientation of the cone shape. FIGS. 2 and 4 show the first end 52 being in slide fit engagement with the sealing shoulder surface 36 in the first configuration.

FIGS. 2-4 also show the sealing member 60 being mounted around the sleeve member 40 between the abutment end 46 and the free end 48, the cone assembly 70 being mounted around the sleeve member 40 and being in mechanical engagement with the sealing member 60, and the slip device 72 being mounted around the sleeve member 40 and being in sliding engagement with the cone assembly 70. The sealing member 60 has an expanded position (FIGS. 3-4) and an extended position (FIG. 2). The sealing member 60 in the expanded position of FIGS. 3-4 having a diameter 62 larger than the sealing member 60 in the extended position of FIG. 2. In the embodiment with the abutment end 46 being comprised of a conical wedge 50, the second end 54 is in mechanical engagement with the sealing member 60 so as to transition the sealing member 60 from the extended position to the expanded position. That is, the second end 54 is adjacent or in contact with the sealing member 60 so as to exert pressure on the sealing member 60. The pressure can compress the sealing member 60 in the extended position of FIG. 2 into the expanded position of FIGS. 3-4.

In the present invention, the second configuration of the setting mandrel 20 corresponds to the sealing member 60 in the expanded position of FIG. 3. The first configuration of the setting mandrel 20 corresponds to both the sealing member 60 in the expanded position (FIG. 4) and the sealing member 60 in the extended position (FIG. 2).

The sealing member 60, cone assembly 70, and slip device 72 can be conventional components of a packer to set the frac plug system 10 in position in the wellbore. The anchoring to the wellbore by the slip device 72, the sealing against the wellbore by the sealing member 60, and the sliding of the cone assembly 70 to press the slip device 72 into the wellbore are shown in FIGS. 2-4. The particular embodiments show the sealing member 60 between the abutment end 46 of the sleeve member 40 and the cone assembly 70 and the cone assembly 70 between the sealing member 60 and the slip device 72. The slip device 72 is farther from the abutment end 46 of the sleeve member 40 with the sealing member 60 in the expanded position (FIG. 2) than with the sealing member 60 in the extended position (FIGS. 3-4). The cone assembly 70 is closer to the slip device 72 with the sealing member 60 in the expanded position (FIGS. 3-4) than with the sealing member 60 in the extended position (FIG. 2).

FIGS. 2-4 also show the method for isolating a zone in a wellbore as an embodiment of the present invention. The method comprises the step of running a frac plug system 10 in a borehole with a setting tool 80. FIG. 2 shows the step of running with the setting mandrel 20 in the first configuration and the sealing member 60 in the extended position. The sealing member 60 has the smaller diameter 62 so that the packer system 10 can pass through the wellbore more easily. The method of the present invention further includes placing the frac plug system 10 in a location in the wellbore. The step of placing the frac plug system in the location can comprise the step of breaking the setting mandrel 20 with the setting tool 80 (FIG. 2 attached, FIGS. 3-4 detached).

FIG. 3 shows the steps of transitioning the sealing member 60 in the extended position to the sealing member 60 in the expanded position at the location and moving the setting mandrel 20 from the first configuration to the second configuration so as to form a fluid connection through the fluid bypass slots 30 in a first setting stage of setting in position. The sealing member 60, cone assembly 70, and slip device 72 anchor the packer system 10 to the wellbore, but setting in position is not yet complete. The setting mandrel 20 is not yet in a final position. The pre-set seal at the seal end 26 is not in position yet.

In some embodiments, the step of transitioning the sealing member 60 in the extended position to the sealing member 60 in the expanded position includes applying fluid pressure on the sleeve member 40 so as to compress the sealing member 60 from the extended position to the expanded position. FIG. 3 shows the abutment end 46 as the conical wedge 50, so the first end 52 is in slide fit engagement with the sealing shoulder surface 36 in the first configuration and the second end 54 is in mechanical engagement with the sealing member 60 so as to transition the sealing member 60 from the extended position to the expanded position. The fluid pressure applied to the second end 54 of the abutment end 46 of the sleeve member 60 exerts force on the sealing member 60, cone assembly 70, and slip device 72 to anchor to the wellbore and slides the sleeve member 40 relative to the setting mandrel 20 to the second configuration (FIG. 3). The fluid pressure moves the sleeve member 40 towards the flow end 28 of the mandrel body 22 so as to position the sleeve member 40 between the closed end 34 of each fluid bypass slot 30 and the flow end 28 of the mandrel body 22 for the second configuration of the setting mandrel 20.

At this first setting stage for setting in position, FIG. 3 shows the fluid connection through the frac plug system 10. The frac plug system 10 is anchored in place, but the seal end 26 has not yet sealed the wellbore. When the position of the frac plug system 10 within the wellbore is acceptable, the method of the present invention proceeds with the step of moving the setting mandrel 20 from the second configuration to the first configuration so as to seal the fluid connection in a second setting stage (FIG. 4).

FIG. 4 shows the second setting stage with the second end 54 of the abutment end 46 in mechanical engagement with the sealing member 60 so as to move the setting mandrel 20 from the second configuration to the first configuration. The mechanical engagement is being adjacent or other contact so as to exert force on each other. The sealing member 60 is now anchored in the wellbore in the expanded position and with the slip device 72 attached to the wellbore. Thus, the sleeve member 40 is now anchored in place. The method of the present invention now includes the step of moving the setting mandrel 20 from the second configuration back to the first configuration.

In some embodiments, the moving back to the first configuration comprises the step of applying additional fluid pressure on the seal end 26 of the mandrel body 22. The original amount of fluid pressure is sufficient to move the sleeve member 40 until the sleeve member 40 was anchored in place. An additional fluid pressure is now applied to move the setting mandrel 20 towards the free end 48 of the sleeve member 40. The sealing shoulder surface 36 is back against the abutment end 46 of the sleeve member 40 so as to seal the fluid connection in the second setting stage.

In the second setting stage, the setting in position is completed so that the pre-set seal can form a seal across the frac plug system 10 to isolate a zone.

Embodiments of the method of the present invention further include an alternative at the first setting stage of FIG. 3, when the frac plug system 10 is anchored in place, but the seal end 26 has not yet sealed the wellbore. When the frac plug system 10 is in the wrong place, the method of the present invention now includes the step of injecting fluids through the fluid bypass slots 30 so as to remove the frac plug system 10. If triggered by accident, the frac plug system 10 is no longer sealed concurrent with setting in position. Strong acid can be injected to dissolve the frac plug system 10 so that the frac plug system is removed from the wrong place in the wellbore. The fluid bypass slots 30 allow pumping acid or other additives to be delivered to the frac plug system 10.

The method of this embodiment is the same steps for placing the frac plug system 10 in the location by breaking the setting mandrel 20 with the setting tool 80 and moving the setting mandrel 20 from the first configuration to the second configuration by applying fluid pressure on the sleeve member 40, moving the sleeve member 40 towards the flow end 28 of the mandrel body 22, and moving the sleeve member 40 between the closed end 34 of at least one fluid bypass slot 30 and the flow end 28 of the mandrel body 22. Instead of applying additional fluid pressure to move the setting mandrel 20 to the now anchored sleeve member 40, this alternative embodiment injects strong acid to dissolve components of the frac plug system 10 so that the frac plug system 10 is removed from the location within the wellbore.

The present invention provides a frac plug system to isolate zones in a wellbore. The frac plug system is pre-set because no additional stage is needed to set the seal. A frac ball is not dropped to form the seal. There is no ball seat or other valve seat to accommodate a frac ball in the frac plug system of the present invention. The time, components, and risk of a frac ball for form the seal is avoided. Additionally, the risk of accidental triggering the frac plug with a pre-set frac ball is also avoided. The present invention further includes the frac plug system having multiple stages for setting in position to isolate the wellbore. Despite this pre-setting of the seal, the setting in position includes multiple stages. Before all stages of setting in position are complete, it is possible to remove the frac plug system by injecting strong acid to dissolve components of the frac plug system. If the frac plug system was accidentally triggered in the wellbore to set position, there is no longer an automatic set position and set seal that cannot be easily removed.

Embodiments of the present invention include a frac plug system having a setting mandrel with fluid bypass slots and a sleeve member. These components are positioned and have structures for fluid connection relationships so that fluid pressure variation controls isolating a zone. Also, the fluid pressure actuation of the setting mandrel and sleeve member allows the frac plug system to be removed at a first setting stage before a second setting stage.

The foregoing disclosure and description of the invention is illustrative and explanatory thereof. Various changes in the details of the illustrated structures, construction and method can be made without departing from the true spirit of the invention.

We claim:

1. A frac plug system, comprising:

a setting mandrel being comprised of:

a mandrel body with an outer mandrel surface, a seal end and a flow end opposite said seal end;

a plurality of fluid bypass slots extending longitudinally along said mandrel body from said flow end toward said seal end, each slot having an opened end at said flow end of said mandrel body and a closed end between said seal end and said flow end; and a sealing shoulder surface at said seal end, said closed end being between said sealing shoulder surface and said flow end;

a sleeve member being comprised of:

a sleeve body with an outer sleeve surface, an abutment end and a free end opposite said abutment end, wherein said setting mandrel has a first configuration with said seal end adjacent said abutment end of said sleeve member, and a second configuration with said closed end between said seal end and said abutment end;

a sealing member being mounted around said sleeve member between said abutment end and said free end, said sealing member having an expanded position and an extended position, said sealing member in said expanded position having a diameter larger than said sealing member in said extended position;

a cone assembly being mounted around said sleeve member and being in mechanical engagement with said sealing member; and a slip device being mounted around said sleeve member, said cone assembly being in sliding engagement with said slip device, wherein said second configuration of said setting mandrel corresponds to said sealing member in said expanded position, and wherein said first configuration of said setting mandrel corresponds to both said sealing member in said expanded position and said sealing member in said extended position.

2. The frac plug system, according to claim 1, wherein said setting mandrel is further comprised of an O-ring groove between said closed end and said opened end of each slot, further comprising:

an O-ring set in said O-ring groove.

3. The frac plug system, according to claim 2, wherein said setting mandrel is further comprised of an additional O-ring groove between said closed end and said O-ring groove opened end of each slot, further comprising:

an additional O-ring set in said additional O-ring groove.

4. The frac plug system, according to claim 1, wherein said abutment end is comprised of a conical wedge having a first end facing said sealing shoulder surface and a second end opposite said first end, said first end being wider than said second end.

5. The frac plug system, according to claim 4, said first end being in slide fit engagement with said sealing shoulder surface in said first configuration.

6. The frac plug system, according to claim 4, wherein said second end is in mechanical engagement with said sealing member so as to transition said sealing member from said extended position to said expanded position.

7. The frac plug system, according to claim 1, wherein said sealing member is between said abutment end and said cone assembly, and wherein said cone assembly is between said sealing member and said slip device.

8. The frac plug system, according to claim 7, wherein said slip device is farther from said sleeve member with said sealing member in said expanded configuration than with said sealing member in said extended configuration.

9. The frac plug system, according to claim 7, wherein said cone assembly is closer to said slip device with said sealing member in said expanded configuration than with said sealing member in said extended configuration.

10. A method for isolating a zone in a wellbore, the method comprising the steps of:

running a frac plug system, according to claim 1, in a borehole with a setting tool, said setting mandrel being in said first configuration, said sealing member being in said extended position;

placing said frac plug system in a location in the wellbore;

transitioning said sealing member in said extended position to said sealing member in said expanded position with said frac plug system in said location;

moving said setting mandrel from said first configuration to said second configuration so as to form a fluid connection through said fluid bypass slots in a first setting stage; and moving said setting mandrel from said second configuration to said first configuration so as to seal said fluid connection in a second setting stage.

11. The method for isolating, according to claim 10, wherein the step of placing said frac plug system in said location comprises the step of breaking said setting mandrel with said setting tool.

12. The method for isolating, according to claim 10, wherein the step of transitioning said sealing member in said extended position to said sealing member in said expanded position with said frac plug system comprises the steps of:

applying fluid pressure on said sleeve member; and compressing said sealing member from said extended position to said expanded position.

13. The method for isolating, according to claim 12, wherein said abutment end is comprised of a conical wedge having a first end facing said sealing shoulder surface and a second end opposite said first end, said first end being wider than said second end, said first end being in slide fit engagement with said sealing shoulder surface in said first configuration, and wherein said second end is in mechanical engagement with said sealing member so as to transition said sealing member from said extended position to said expanded position, the method further comprising the step of:

exerting pressure on said sealing member by said second end of said abutment end.

14. The method for isolating, according to claim 12, wherein the step of moving said setting mandrel from said first configuration to said second configuration comprises the steps of:

moving said sleeve member towards said flow end of said mandrel body with said fluid pressure; and placing said sleeve member between said closed end and said flow end of said mandrel body in said first setting stage with said fluid pressure.

15. The method for isolating, according to claim 12, wherein said second end is in mechanical engagement with said sealing member so as to move said setting mandrel from said second configuration to said first configuration.

16. The method for isolating, according to claim 15, wherein the step of moving said setting mandrel from said second configuration to said first configuration comprises the steps of:

applying additional fluid pressure on said seal end of said mandrel body;

moving said setting mandrel towards said free end of said sleeve member; and setting said sealing shoulder surface against said abutment end of said sleeve member so as to seal said fluid connection in said second setting stage.

17. A method for correcting placement in a wellbore, the method comprising the steps of:

running a frac plug system, according to claim 1, in a borehole with a setting tool, said setting mandrel being in said first configuration, said sealing member being in said extended position;

placing said frac plug system in a location in the wellbore;

transitioning said sealing member in said extended position to said sealing member in said expanded position with said frac plug system in said location;

moving said setting mandrel from said first configuration to said second configuration so as to form a fluid connection through said fluid bypass slots in a first setting stage; and injecting fluids through said fluid bypass slots so as to remove said frac plug system.

18. The method for correcting placement, according to claim 17, wherein the step of placing said frac plug system in said location comprises the step of breaking said setting mandrel with said setting tool.

19. The method for correcting placement, according to claim 17, wherein the step of transitioning said sealing member in said extended position to said sealing member in said expanded position with said frac plug system comprises the steps of:

applying fluid pressure on said sleeve member; and compressing said sealing member from said extended position to said expanded position.

20. The method for correcting placement, according to claim 17, wherein the step of injecting fluids through said fluid bypass slots so as to remove said frac plug system comprises the step of:

dissolving said frac plug system, said fluids being comprised of acid.

* * * * *